US007431608B2

(12) United States Patent
Sakaguchi et al.

(10) Patent No.: US 7,431,608 B2
(45) Date of Patent: Oct. 7, 2008

(54) SHIELDED CABLE CONNECTING STRUCTURE

(75) Inventors: Tadahisa Sakaguchi, Makinohara (JP); Takayoshi Endo, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/706,998

(22) Filed: Feb. 16, 2007

(65) Prior Publication Data

US 2007/0197097 A1 Aug. 23, 2007

(30) Foreign Application Priority Data

Feb. 20, 2006 (JP) ..... 2006-042734

(51) Int. Cl.
*H01R 4/24* (2006.01)

(52) U.S. Cl. ..... 439/394

(58) Field of Classification Search ..... 439/99, 439/98, 610, 394, 398; 174/78
See application file for complete search history.

(56) References Cited

U.S. PATENT DOCUMENTS 4,416,501 A * 11/1983 Fusselman et al. ..... 439/396
6,951,483 B2 * 10/2005 Kameyama ..... 439/595

FOREIGN PATENT DOCUMENTS

JP 08-340615 A 12/1996

* cited by examiner

*Primary Examiner*—Phuong K Dinh
(74) *Attorney, Agent, or Firm*—Sughrue Mion, PLLC

(57) ABSTRACT

A shielded cable connecting structure for connecting a shielded cable, the shielded cable including an electric wire portion which has a conductor and an inner sheath covering the conductor, a braided wire braided around the inner sheath, and an outer sheath covering the braided wire, the shielded cable connecting structure includes a connecting member. The connecting member includes a connecting main body, a press-fastening portion which press-fastens at least part of the shielded cable, a connecting portion which connects to the braided wire, and a spacer which connects to the braided wire. The spacer increases a contact pressure of the braided wire with the connecting portion.

6 Claims, 11 Drawing Sheets

SHIELDED CABLE CONNECTING STRUCTURE

BACKGROUND OF THE INVENTION

This invention relates to a shielded cable connecting structure used for connecting a braided wire incorporated in a shielded cable.

There is known a related shielded cable connecting structure in which insulating sheaths of shielded cables are removed to thereby expose respective braided wires, and these braided wires are twisted, and then are press-fastened by barrels (see, for example, JP-A-8-340615 (FIG. 1)).

In the shielded cable connecting structure disclosed in JP-A-8-340615, the insulating sheaths 101 of the shielded cables 100 are removed to thereby expose the braided wires 102, and these braided wires 102 are gathered together, and then the shielded cables are press-fastened together by barrels 103, and the braided wires are press-fastened to a drain wire 104 by barrels 105 spaced apart from the barrels 103, as shown in FIG. 17.

However, in the related shielded cable connecting structure disclosed in the JP-A-8-340615, the operation for gathering the exposed braided wires 102 together (that is, a so-called twisting operation) is difficult, and therefore the braided wires 102 (each composed of woven fine wires) become loose, depending on the degree of skill, so that the number of the fine wires decreases, or the capacity decreases. Thus, the efficiency of the operation is not good, and it is difficult to enhance the productivity by achieving the automated operation.

Generally, in order that a disturbance developing around a shielded cable will not intrude into a conductor when flowing a very small voltage signal or a very small current signal through the conductor, a grounded braided wire is provided around the conductor to cover the same so as to capture the disturbance, and the thus captured disturbance is positively flowed to a grounding circuit. Therefore, the capacity of the braided wire is determined in a condition in which the braided wire covers the conductor over the entire periphery thereof. Considering this with respect to the structure of JP-A-8-340615, the areas of non-shielded portions (where the conductor is not covered with the braided wire over the entire periphery thereof increase as a result of gathering the braided wires together, so that there is a fear that the reliability against the disturbance is not satisfactory.

SUMMARY OF THE INVENTION

This invention has been made in view of the above circumstances, and an object of the invention is to provide a shielded cable connecting structure in which a good operation efficiency can be achieved, and a connecting path of a braided wire can be positively secured.

1) According to one aspect of the present invention, there is provided a shielded cable connecting structure for connecting a shielded cable, the shielded cable including an electric wire portion which has a conductor and an inner sheath covering the conductor, a braided wire braided around the inner sheath, and an outer sheath covering the braided wire, the shielded cable connecting structure comprising:

a connecting member that includes:

a connecting main body;

a press-fastening portion which press-fastens at least part of the shielded cable;

a connecting portion which connects to the braided wire; and a spacer which connects to the braided wire, wherein the spacer increases a contact pressure of the braided wire with the connecting portion.

Preferably, the connecting portion is a press-contacting portion or a press-clamping portion.

In the invention of the above Paragraph 1), the braided wire of the shielded cable is connected to the press-contacting portion or the press-clamping portion, and the spacer connected to the braided wire is connected to the connecting member body, so that a connecting path of the braided wire is formed with a large current-carrying capacity. Therefore, the braided wire, while kept braided around the inner sheath, is electrically connected to the connecting member body without being gathered or twisted. Therefore, a good operation efficiency can be achieved, and the connecting path of the braided wire can be positively secured.

2) Preferably, the spacer is formed at a part of the connecting main body.

In the invention of the above Paragraph 2), the braided wire of the shielded cable is connected to the press-contacting portion or the press-clamping portion, and the spacer formed integrally with the connecting member body is connected to the braided wire, so that a connecting path of the braided wire is formed with a large current-carrying capacity. Therefore, the braided wire, while kept braided around the inner sheath, is electrically connected to the connecting member body without being gathered or twisted.

3) Preferably, the spacer is separate from the connecting main body.

In the invention of the above Paragraph 3), the braided wire of the shielded cable is connected to the press-contacting portion or the press-clamping portion, and the spacer separate from the connecting member body is connected to the braided wire, so that a connecting path of the braided wire is formed with a large current-carrying capacity. Therefore, the braided wire, while kept braided around the inner sheath, is electrically connected to the connecting member body without being gathered or twisted.

4) Preferably, the spacer is arranged between the inner sheath and the braided wire of the shielded cable. The spacer is electrically connected to the connecting portion through the braided wire.

In the invention of the above Paragraph 4), the spacer can be connected to the braided wire merely by inserting the spacer between the inner sheath and the braided wire, and therefore the operation for connecting the spacer to the braided wire can be carried out easily, so that the operation efficiency can be further enhanced. In this case, preferably, the spacer is so shaped as to be easily inserted between the inner sheath and the braided wire.

5) Preferably, the connecting member is electrically connected to the shielded cable and a grounding wire.

In the invention of the above Paragraph 5), when the shielded cable is to be connected to a grounding circuit, for example, another wire serving as the grounding wire is beforehand grounded, and by doing so, the shielded cable can be easily grounded via the spacer.

The shielded cable connecting structures of the present invention can solve problems that the operation efficiency is not good because of the need for the gathering or twisting operation and that the reliability against a disturbance is low, and therefore there can be achieved advantages that the good operation efficiency can be achieved and that the grounding path of the braided wire can be positively secured.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the present invention will now be described in detail with reference to the drawings.

First Embodiment

Figure 1:
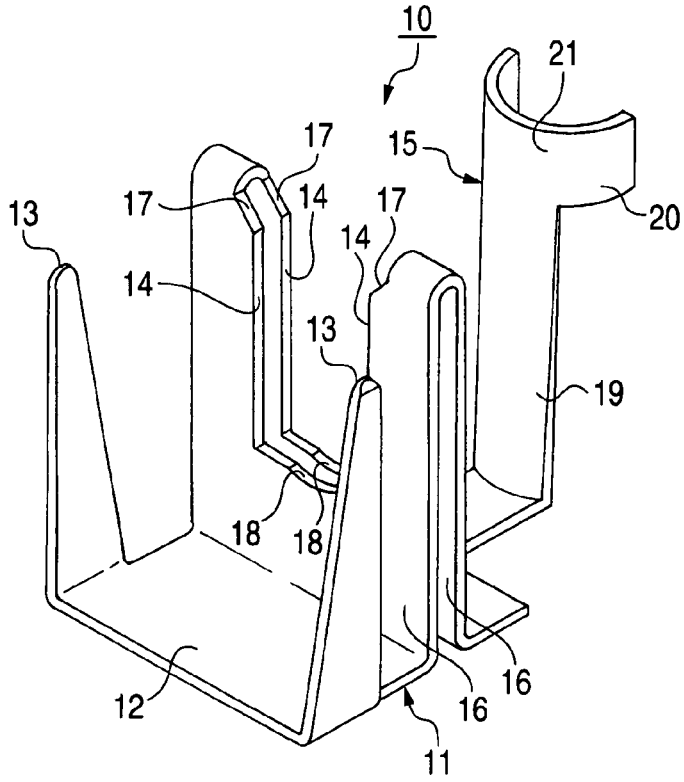
FIG. 1 is a perspective view of a shielded cable connecting jig used in a first embodiment of a shielded cable connecting structure of the present invention, showing its appearance.
Figure 2:
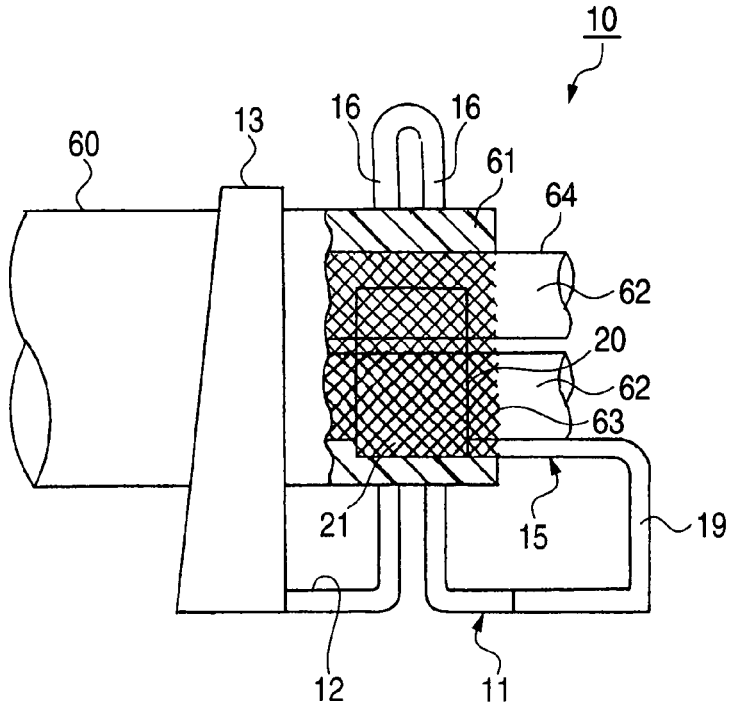
FIG. 2 is a partly-broken, front-elevational view showing a condition in which a shielded cable is connected to the shielded cable connecting jig of FIG. 1.
Figure 3:
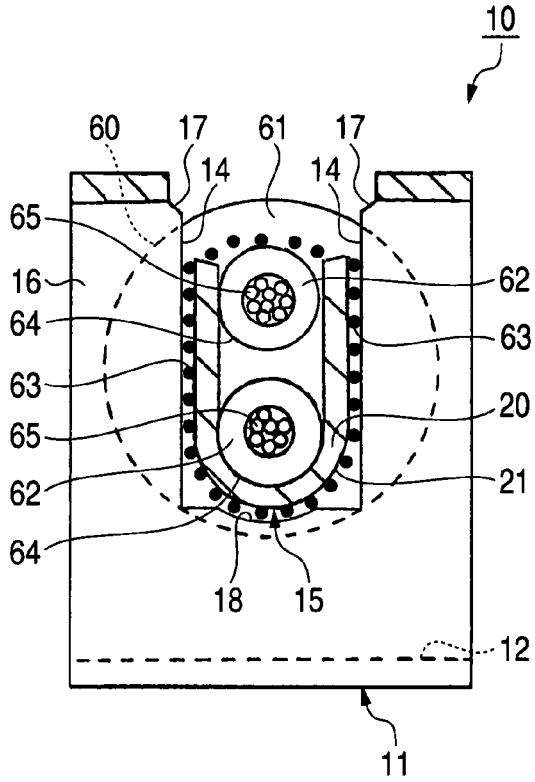
FIG. 3 is a cross-sectional view around the shielded cable of FIG. 2.

First, a first embodiment of a shielded cable connecting structure of the invention will be described with reference to FIGS. 1 to 3. FIG. 1 is a perspective view of a shielded cable connecting jig used in the first embodiment of the shielded cable connecting structure of the invention, showing its appearance, FIG. 2 is a partly-broken, front-elevational view showing a condition in which a shielded cable is connected to the shielded cable connecting jig of FIG. 1, and FIG. 3 is a cross-sectional view around the shielded cable of FIG. 2.

As shown in FIG. 1, the shielded cable connecting jig 10, used in the first embodiment of the shielded cable connecting structure of the invention, includes a connecting member body 11 having a bottom plate 12, a pair of press-fastening portions 13 and 13 formed on and extending upwardly respectively from opposite side edges of the bottom plate 12 at one end portion of the connecting member body 11, a pair of press-contacting portions 14 and 14 formed at a central portion of the connecting member body 11, and a spacer 15 formed integrally at the other end of the connecting member body 11. This connecting jig 10 is made of an ordinary terminal material, that is, electrically-conductive metal such as brass or iron which can not be easily deteriorated by heat.

The shielded cable 60 (see FIG. 2) is inserted between the pair of press-fastening portions 13 and 13, and then these press-fastening portions 13 and 13 are press-deformed inwardly, that is, press-fastened onto an outer periphery of an outer sheath 61 (see FIG. 2) of the shielded cable 60, so that the shielded cable 60 is held by the shielded cable connecting jig 10.

A central portion of the bottom plate 12 is bent to provide a pair of closely opposed plate portions 16 and 16, and an upwardly-open slot or opening is formed in a central portion of each plate portion 16, and opposed side edges of this slot define a pair of opposed press-contacting blades (also designated respectively by reference numerals 14 for convenience' sake) of the press-contacting portion 14, respectively. Each press-contacting portion 14 is continuous with a first insertion guide portion 17 (defined by slanting surfaces also designated respectively by reference numerals 17 for convenience' sake) formed at an upper end of the press-contacting portion 14. Each of the plate portions 16 and 16 has a spacer support portion 18 (in the form of a concavely-curved surface) disposed centrally of a width of the press-contacting portion 14.

The spacer 15 includes an arm portion 19 formed at and extending upwardly from the other end of the bottom plate 12, and an insertion plate portion 20 formed at a distal end of the arm portion 19 and curved into a generally C-shape. An outer peripheral surface of the insertion plate portion 20 serves as a braided wire connecting portion 21. The spacer 15 is formed into such a shape that the insertion plate portion 20 can be easily inserted between each inner sheath 62 (see FIG. 2) and a braided wire 63 (see FIG. 2) of the shielded cable 60.

Before the spacer 15 is used, the arm portion 19 projects upwardly (in FIG. 1), and the shielded cable 60 is pressed to be moved toward the insertion plate portion 20 from the upper side, so that the insertion plate portion 20 is inserted into the interior of the braided wire 63 at a generally inner peripheral portion of the outer sheath 61, and is disposed in contiguous relation to an inner peripheral surface of the braided wire 63. Then, the upwardly-extending arm portion 19 is bent or turned left (i.e., counterclockwise in FIG. 1) at its central portion, so that the insertion plate portion 20, together with the shielded cable 60, is inserted into the pair of press-contacting portions 14 and 14.

As shown in FIG. 2, the shielded cable 60 comprises two signal feeding wires 64 (each including a conductor 65 (see FIG. 3) and the inner sheath 62 covering the outer periphery of the conductor 65), the braided wire 63 braided around the two inner sheaths 62, and the outer sheath 61 covering the outer periphery of the braided wire 63 such that the braided wire 63 is disposed at the generally inner peripheral portion of the outer sheath 61. The conductor 65 is made of an electrically-conductive material such for example as pure copper (Cu) or tin (Sn)-plated pure copper.

When the shielded cable 60 is pressed to be moved toward the shielded cable connecting jig 10 from the upper side, the insertion plate portion 20 of the spacer 15 is inserted into the interior of the braided wire 63 at the generally inner peripheral portion of the outer sheath 61, and is disposed in contiguous relation to the inner peripheral surface of the braided wire 63. Then, the upwardly-extending arm portion 19 is bent or turned left (i.e., counterclockwise in FIG. 2) at its central portion, so that the shielded cable 60 having the insertion plate portion 20 inserted therein is pressed to be inserted into the pair of press-contacting portions 14 and 14. As a result, the press-contacting portions 14 and 14 cut the outer sheath 61 of the shielded cable 60, and are press-contacted with the braided wire 63 to be electrically connected thereto.

When the shielded cable 60 is thus pressed to be inserted into the press-contacting portions 14 and 14, the outer peripheral surface of the braided wire 63 is electrically connected to the press-contacting portions 14 and 14 with large contact areas, and also the inner peripheral surface of the braided wire 63 is electrically connected to the braided wire connecting portion 21 with a large contact area, as shown in FIG. 3. As a result, the braided wire 63 is electrically connected to the connecting member body 11 via the press-contacting portions 14 and 14 and the insertion plate portion 20 of the spacer 15 with a large current-carrying capacity.

For forming the shielded cable connecting jig 10, an electrically-conductive metal sheet having a predetermined thickness is cut into a predetermined developed shape, and then the pair of press-fastening portions 13 and 13, the pair of plate portions 16 and 16 and the spacer 15 are formed by bending relevant portions of the thus cut sheet relative to the bottom plate 12. Thus, this method does not include any complicated processing step, and therefore the shielded cable connecting jig 10 can be formed using existing facilities.

When the shielded cable connecting jig 10 is to be used, the shielded cable 60 is pressed to be inserted into the press-contacting portions 14 and 14, and then the press-fastening portions 13 and 13 are press-fastened to the shielded cable 60 to fix this shielded cable 60, and the shielded cable connecting jig 10 is electrically connected, for example, to a grounding terminal or a bus bar on a circuit board or a metallic grounding member such as vehicle body panel. As a result, the braided wire connecting portion 21 of the insertion plate portion 20 of the spacer 15 is electrically connected to the inner peripheral surface of the braided wire 63 with the large contact area, and also the press-contacting portions 14 and 14 are electrically connected to the outer peripheral surface of the braided wire 63 with the large contact areas. Therefore, even when a disturbance develops around the shielded cable 60, disturbance components captured by the braided wire 63 flow through the spacer 15, that is, flow sequentially through the insertion plate portion 20, the arm portion 19 and the connecting member body 11, and also flow sequentially through the press-contacting portions 14 and 14 and the connecting member body 11. Thus, the disturbance components are positively flowed to a grounding circuit, thereby protecting the conductors 65 of the wires 64 from the disturbance.

As described above, in the shielded cable connecting structure of the first embodiment, when the shielded cable 60 is pressed to be inserted into the press-contacting portions 14 and 14, the braided wire 63 is connected to the press-contacting portions 14 and 14, and also the insertion plate portion 20 of the spacer 15 formed integrally with the connecting member body 11 is connected to the braided wire 63, so that the connecting path of the braided wire 63 is formed with the large current-carrying capacity. Therefore, the braided wire 63, while kept braided around the inner sheaths 62, is electrically connected to the connecting member body 11 without being gathered or twisted. Therefore, the good operation efficiency can be achieved, and besides the connecting path of the braided wire can be positively secured.

Furthermore, in the shielded cable connecting structure of the first embodiment, merely by inserting the insertion plate portion 20 of the spacer 15 between the inner sheaths 62 and the braided wire 63, the spacer 15 can be connected to the braided wire 63, and therefore the operation for connecting the spacer 15 to the braided wire 63 can be effected more easily, and besides the automated operation can be carried out, so that the operation efficiency can be further enhanced.

Second Embodiment

Figure 4:
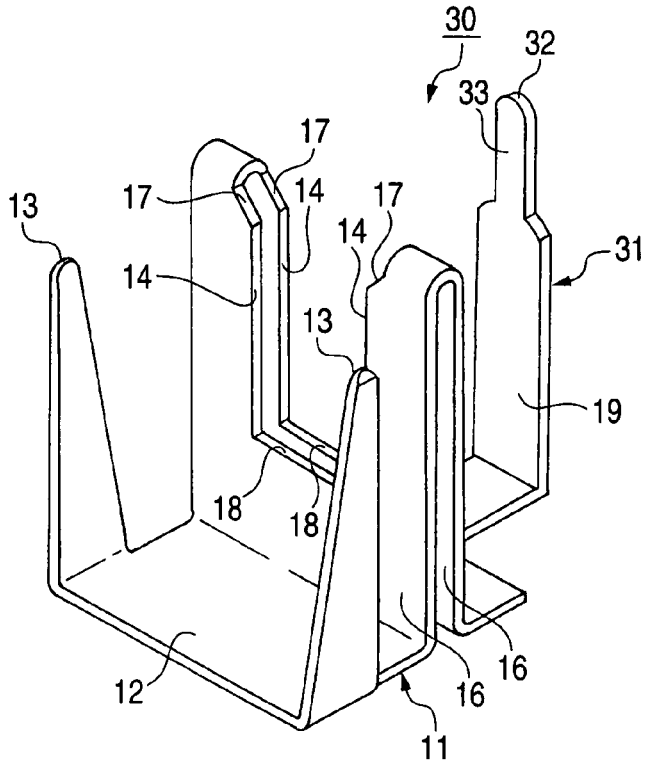
FIG. 4 is a perspective view of a shielded cable connecting jig used in a second embodiment of a shielded cable connecting structure of the invention, showing its appearance.
Figure 5:
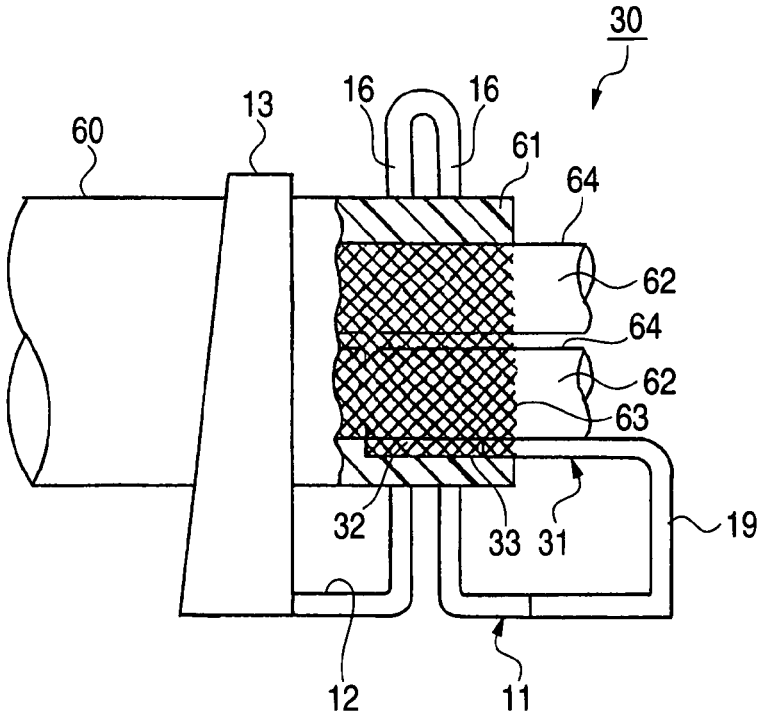
FIG. 5 is a partly-broken, front-elevational view showing a condition in which a shielded cable is connected to the shielded cable connecting jig of FIG. 4.
Figure 6:
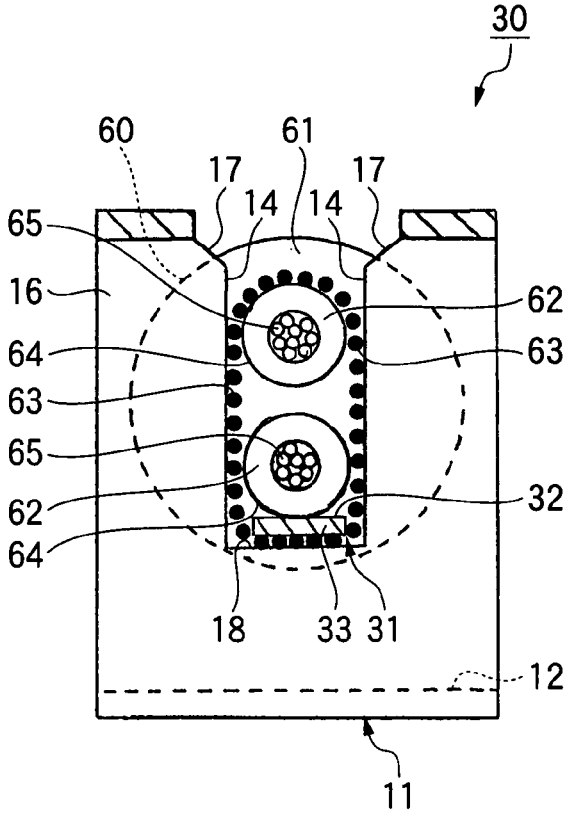
FIG. 6 is a cross-sectional view around the shielded cable of FIG. 5.

Next, a second embodiment of a shielded cable connecting structure of the invention will be described with reference to FIGS. 4 to 6. FIG. 4 is a perspective view of a shielded cable connecting jig used in the second embodiment of the shielded cable connecting structure of the invention, showing its appearance, FIG. 5 is a partly-broken, front-elevational view showing a condition in which a shielded cable is connected to the shielded cable connecting jig of FIG. 4, and FIG. 6 is a cross-sectional view around the shielded cable of FIG. 5. In the following embodiments including this second embodiment, those constituent elements identical or similar in function to those of the first embodiment will be designated by identical or like reference numerals, respectively, and detail explanation thereof will be simplified or omitted.

As shown in FIG. 4, the shielded cable connecting jig 30, used in the second embodiment of the shielded cable connecting structure of the invention, includes a spacer 31 formed integrally with a connecting member body 11. The spacer 31 includes a tab-like insertion plate portion 32 formed at a distal end of the spacer 31. The insertion plate portion 32 is thus formed into a tab-like shape, and therefore can be easily inserted between an inner sheath 62 and a braided wire 63 of the shielded cable 60. An inner surface of the insertion plate portion 32 serves as a braided wire connecting portion 33. In this case, each of spacer support portions 18 and 18 is in the form of a flat surface. The other portions are identical in construction to the corresponding portions of the first embodiment.

The shielded cable 60 is moved downward toward the spacer 31 of the shielded cable connecting jig 30 from the upper side, so that the insertion plate portion 32 is inserted between the inner sheath 62 and the braided wire 63 of the shielded cable 60. When the insertion plate portion 32 is thus inserted between the inner sheath 62 and the braided wire 63 of the shielded cable 60, the insertion plate portion 32 is electrically connected to the braided wire 63.

Then, the shielded cable 60 is tilted or turned counterclockwise (in FIG. 4), so that an arm portion 19 of the spacer 31 is bent at its central portion in accordance with the tilting movement of the shielded cable 60.

When the tilted shielded cable 60 is pressed to be inserted into press-contacting portions 14 and 14, the press-contacting portions 14 and 14 cut an outer sheath 61 of the shielded cable 60, and are press-contacted with the braided wire 63 to be electrically connected thereto, as shown in FIG. 5.

When the shielded cable 60 is thus pressed to be inserted into the press-contacting portions 14 and 14, an outer peripheral surface of the braided wire 63 is electrically connected to the press-contacting portions 14 and 14 with large contact areas, and also an inner peripheral surface of the braided wire 63 is electrically connected to the braided wire connecting portion 33 of the insertion plate portion 32 of the spacer 31 with a large contact area. As a result, the braided wire 63 is electrically connected to the connecting member body 11 through the press-contacting portions 14 and 14 and the insertion plate portion 32 of the spacer 31 with a large current-carrying capacity.

In the shielded cable connecting jig 30, the braided wire connecting portion 33 of the insertion plate portion 32 of the spacer 31 is electrically connected to the inner peripheral surface of the braided wire 63 with the large contact area, and also the press-contacting portions 14 and 14 are electrically connected to the outer peripheral surface of the braided wire 63 with the large contact areas. Therefore, even when a disturbance develops around the shielded cable 60, disturbance components captured by the braided wire 63 flow through the spacer 31, that is, flow sequentially through the insertion plate portion 32, the arm portion 19 and the connecting member body 11, and also flow sequentially through the press-contacting portions 14 and 14 and the connecting member body 11. Thus, the disturbance components are positively flowed to a grounding circuit, thereby protecting conductors 65 of wires 64 from the disturbance.

As described above, in the shielded cable connecting structure of the second embodiment, when the shielded cable 60 is pressed to be inserted into the press-contacting portions 14 and 14, the braided wire 63 is connected to the press-contacting portions 14 and 14, and also the insertion plate portion 32 of the spacer 31 formed integrally with the connecting member body 11 is connected to the braided wire 63, so that a connecting path of the braided wire 63 is formed with a large current-carrying capacity. Therefore, the braided wire 63, while kept braided around the inner sheaths 62, is electrically connected to the connecting member body 11 without being gathered or twisted. Therefore, the good operation efficiency can be achieved, and besides the connecting path of the braided wire can be positively secured.

Furthermore, in the shielded cable connecting structure of the second embodiment, merely by inserting the insertion plate portion 32 of the spacer 31 between the inner sheath 62 and the braided wire 63, the spacer 31 can be connected to the braided wire 63, and therefore the operation for connecting the spacer 31 to the braided wire 63 can be effected more easily, and besides the automated operation can be carried out, so that the operation efficiency can be further enhanced.

Third Embodiment

Figure 7:
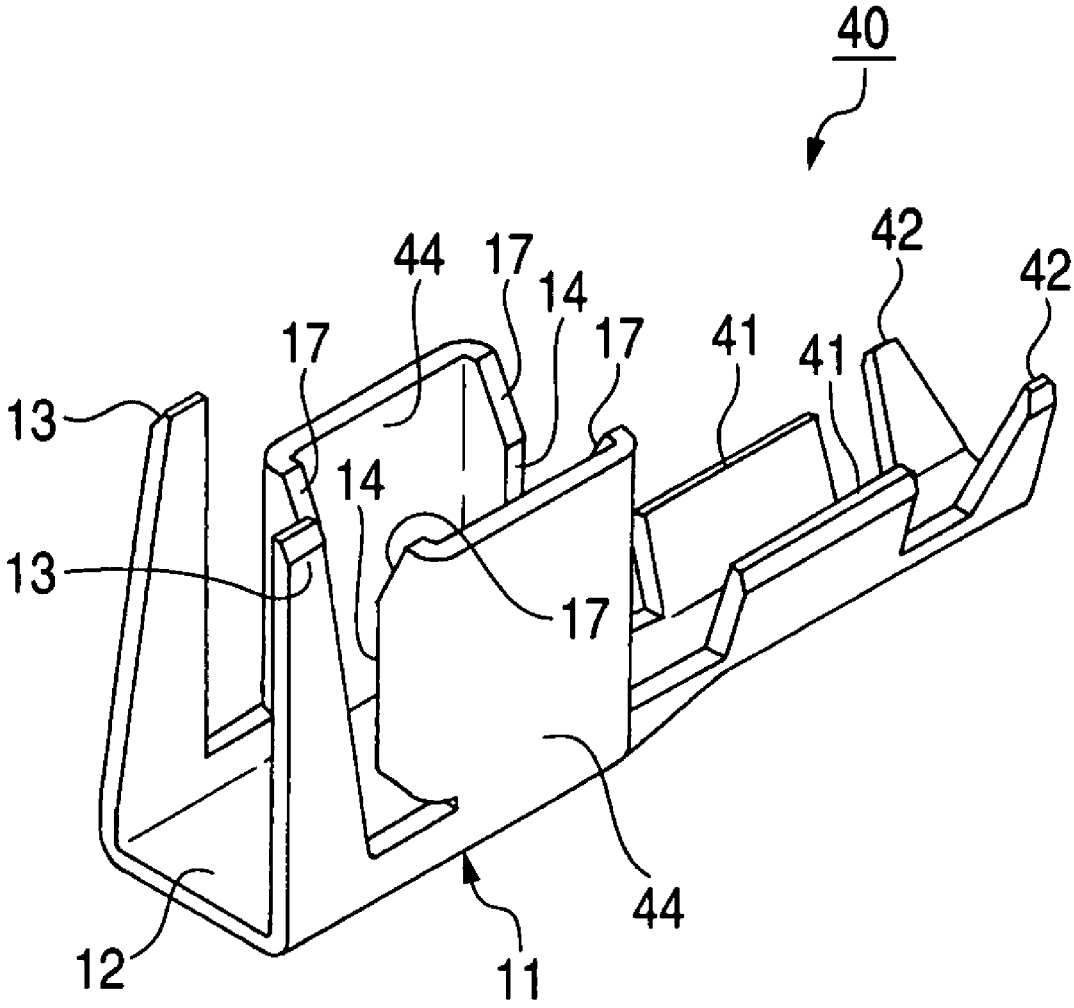
FIG. 7 is a perspective view of a shielded cable connecting jig used in a third embodiment of the shielded cable connecting structure of the invention, showing its appearance.
Figure 8:
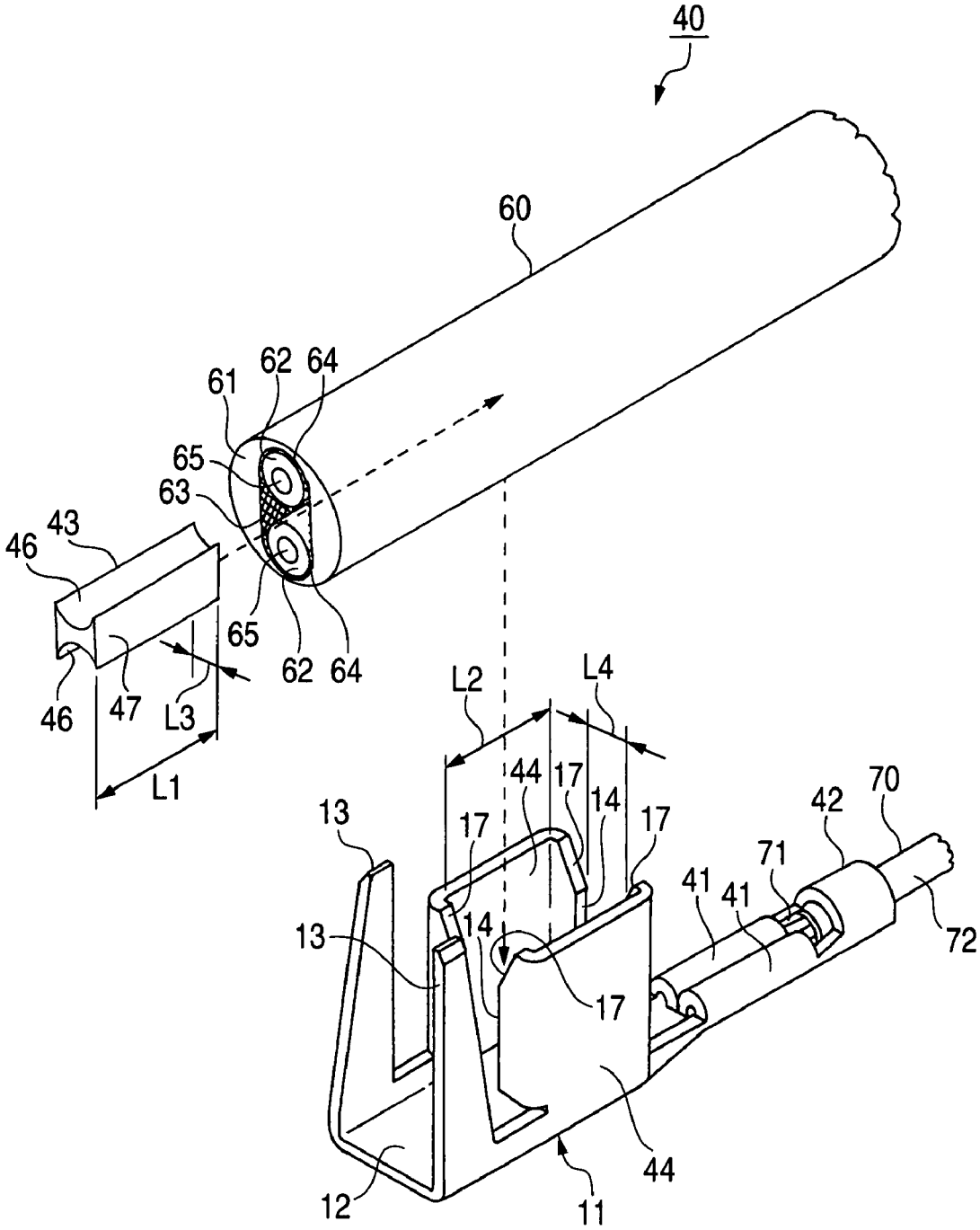
FIG. 8 is a perspective view showing the manner of connecting a shielded cable to the shielded cable connecting jig of FIG. 7.
Figure 9:
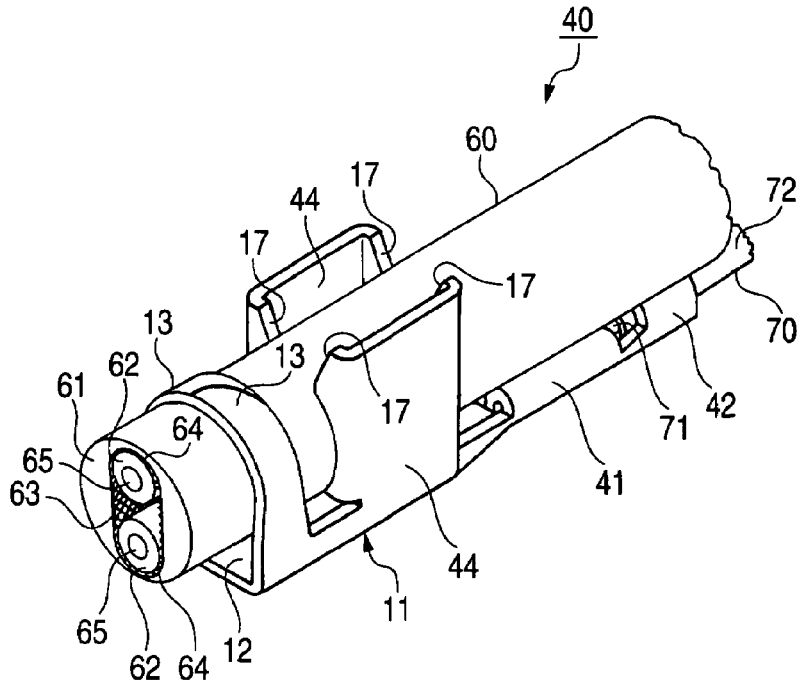
FIG. 9 is a perspective view showing a condition in which the shielded cable is connected to the connecting jig of FIG. 8.
Figure 10:
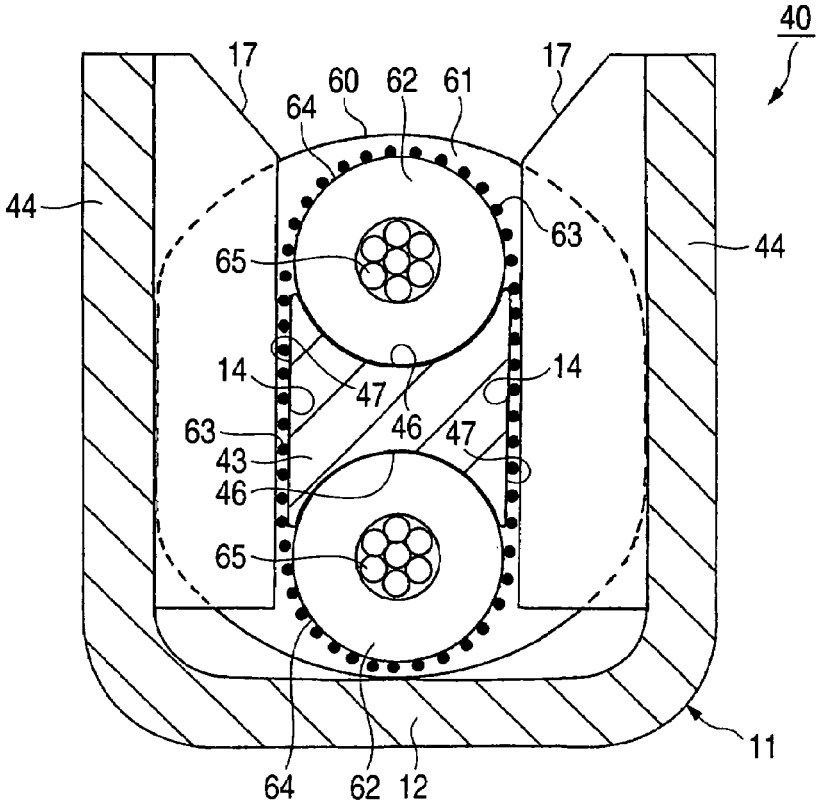
FIG. 10 is a cross-sectional view around the shielded cable of FIG. 9.

Next, a third embodiment of a shielded cable connecting structure of the invention will be described with reference to FIGS. 7 to 10. FIG. 7 is a perspective view of a shielded cable connecting jig used in the third embodiment of the shielded cable connecting structure of the invention, showing its appearance, FIG. 8 is a perspective view showing the manner of connecting a shielded cable to the shielded cable connecting jig of FIG. 7, FIG. 9 is a perspective view showing a condition in which the shielded cable is connected to the connecting jig of FIG. 8, and FIG. 10 is a cross-sectional view around the shielded cable of FIG. 9.

As shown in FIG. 7, the shielded cable connecting jig 40, used in the third embodiment of the shielded cable connecting structure of the invention, includes a connecting member body 11 having a bottom plate 12, and a pair of press-fastening portions 13 and 13 formed on and extending upwardly respectively from opposite side edges of the bottom plate 12 at one end portion of the connecting member body 11. The shielded cable connecting jig 40 further includes a pair of press-contacting portions 14 and 14 formed on and extending upwardly respectively from the opposite side edges of the bottom wall 12 at a central portion of the connecting member body 11, a pair of conductor press-fastening portions 41 and 41 formed on and extending upwardly respectively from the opposite side edges of the bottom plate 12 at that portion of the connecting member body 11 disposed adjacent to the other end portion thereof, and a pair of grounding wire press-fastening portions 42 and 42 formed on and extending upwardly respectively from the opposite side edges of the bottom plate 12 at the other end portion of the connecting member body 11. The shielded cable connecting jig 40 is provided with a separate spacer 43 (see FIG. 8). This shielded cable connecting jig 40 is used for the shielded cable 60 containing two wires 64 and 64, and a grounding wire (another wire) 70 (see FIG. 8) is connected to this connecting jig 40.

A pair of opposed side plates 44 and 44 extend upwardly respectively from the opposite side edges of the bottom plate 12, and opposite end portions of each side plate 44 spaced from each other in the direction of the length of the bottom plate 12 are bent inwardly to form press-contacting blades (which are also designated respectively by reference numerals 14 and 14 for convenience' sake), respectively, and the opposed press-contacting blades (14 and 14) of the two side plates 44 and 44 at their one end portions define one press-contacting portion 14, while the opposed press-contacting blades (14. 14) of the two side plates 44 and 44 at their other end portions define the other press-contacting portion 14.

A conductor 71 of the grounding wire 70 is inserted between the conductor press-fastening portions 41 and 41, and then these press-fastening portions 41 and 41 are press-fastened to the conductor 71, thereby electrically connecting the conductor 71 to the shielded cable connecting jig 40.

The grounding wire 70 is inserted between the grounding wire press-fastening portions 42 and 42, and then these press-fastening portions 42 and 42 are press-fastened to the grounding wire 70 in surrounding relation thereto, thereby fixing the grounding wire 70 to the shielded cable connecting jig 40.

As shown in FIG. 8, the spacer 43 is made of an ordinary terminal material, that is, electrically-conductive metal such as brass or iron which can not be easily deteriorated by heat. This spacer 43 includes a pair of upper and lower wire support surfaces 46 and 46 of a concave shape facing away from each other, and a pair of braided wire connecting portions 47 and 47 formed at opposite sides of the wire support surfaces 46 and 46. Each of the wire support surfaces 47 and 47 has a concave shape similar to an outer shape of a braided wire 63 of the shielded cable 60. A length L1 of the spacer 43 is slightly larger than the distance L2 between the pair of press-contacting portions 14 and 14 spaced from each other in the direction of the length of the bottom plate 12. A width L3 of the spacer 43 is slightly smaller than the distance (or gap) L4 between the opposed press-contacting blades (14 and 14) of each press-contacting portion 14. The spacer 43 is made of the ordinary terminal material, that is, the electrically-conductive metal such as brass or iron which can not be easily deteriorated by heat, and therefore this spacer 43 has a large current-carrying capacity and a predetermined impedance.

The grounding wire 70 has the conductor 71 provided within a sheath 72, and this grounding wire 70 is electrically connected, for example, to a metallic part such as a vehicle body panel in order to form a grounding circuit for an electrical equipment or the like including a resin-made casing.

For assembling the connecting structure, first, the conductor 71 of the grounding wire 70 is inserted between the pair of conductor press-fastening portions 41 and 41, and then these press-fastening portions 41 and 41 are press-fastened to the conductor 71, thereby electrically connecting the conductor to the connecting member body 11. Also, the sheath 72 of the grounding wire 70 is inserted between the pair of grounding wire press-fastening portions 42 and 42, and then these press-fastening portions 42 and 42 are press-fastened to the sheath 72, thereby fixing the grounding wire 70 to the shielded cable connecting jig 40.

Then, the spacer 43 is inserted into the braided wire 63, braided around the two wires 64 and 64, from a cut end of the shielded cable 60, and is disposed between the two wires 64 and 64. At this time, the spacer 43 is inserted into a position where the spacer 43, contacting the wires 64 and 64, is to be pressed contacted with the press-contacting portions 14 and 14 through the braided wire 63.

Then, the shielded cable 60 having the spacer 43 inserted therein is pressed to be inserted into the pair of press-contacting portions 14 and 14.

When the shielded cable 60 having the spacer 43 inserted therein is thus pressed to be inserted into the pair of press-contacting portions 14 and 14, the press-contacting portions 14 and 14 cut an outer sheath 61 of the shielded cable 60, and are press-contacted with the braided wire 63 to be electrically connected thereto, as shown in FIG. 9. Then, the press-fastening portions 13 and 13 are press-fastened to the shielded cable 60, thereby fixing the shielded cable 60 to the shielded cable connecting jig 40.

In the shielded cable connecting jig 40, the braided wire connecting portions 47 and 47 (formed respectively at the opposite side surfaces of the spacer 43) of the spacer 43 inserted in the press-contacting portions 14 and 14 (that is, inserted between the opposed press-contacting blades (14 and 14) of each press-contacting portion 14) are electrically connected to the press-contacting portions 14 and 14 with large contact areas, with the braided wire 63 held between each braided wire connecting portion 47 and the corresponding press-contacting blades (14). Therefore, even when a disturbance develops around the shielded cable 60, disturbance components captured by the braided wire 63 positively flow from the press-contacting portions 14 and 14 to the grounding wire 70 through the spacer 43, thereby protecting conductors 65 and 65 of the wires 64 and 64 from the disturbance.

As described above, in the shielded cable connecting structure of the third embodiment, when the shielded cable 60 is pressed to be inserted into the press-contacting portions 14 and 14, the braided wire 63 is connected to the press-contacting portions 14 and 14, and also the spacer 43 separate from the connecting member body 11 is connected to the braided wire 63, so that a connecting path of the braided wire 63 is formed with a large current-carrying capacity. Therefore, the braided wire 63, while kept braided around the inner sheaths 62, is electrically connected to the connecting member body 11 without being gathered or twisted.

Furthermore, in the shielded cable connecting structure of the third embodiment, when connecting the shielded cable 60 to the grounding circuit, the shielded cable 60 can be easily grounded via the spacer 43 by grounding the grounding wire 70.

Furthermore, in the shielded cable connecting structure of the third embodiment, the braided wire 63 is gripped by the spacer 43 and the press-contacting portions 14 and 14 (that is, the braided wire 63 is held between the spacer 43 and each press-contacting blade (14)), and therefore is much less liable to be affected by a heat change, and therefore the stable connected condition can be maintained for a long period of time, so that the reliability can be enhanced.

Furthermore, in the shielded cable connecting structure of the third embodiment, in the case where the grounding wire 70 is beforehand connected to the shielded cable connecting jig 40, and the connecting jig 40 is delivered in this form, it is not necessary to effect a stock control of grounding wires 70 as by assigning a product number, different from those of other wire harnesses, to the grounding wires 70, and therefore the control of the product numbers can be simplified, so that the productivity can be enhanced.

Fourth Embodiment

Figure 11:
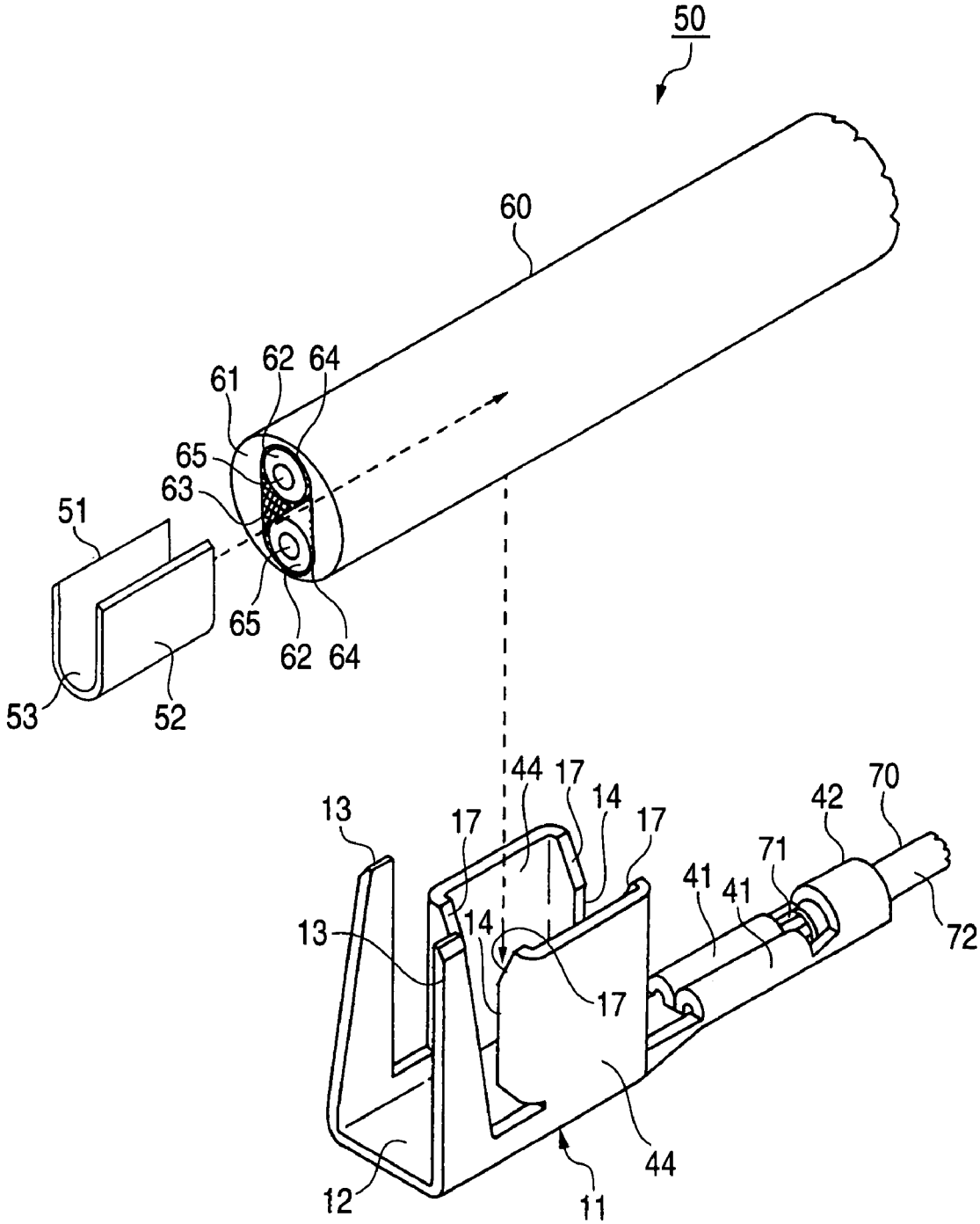
FIG. 11 is a perspective view showing the manner of connecting a shielded cable to a shielded cable connecting jig used in a fourth embodiment of a shielded cable connecting structure of the invention.
Figure 12:
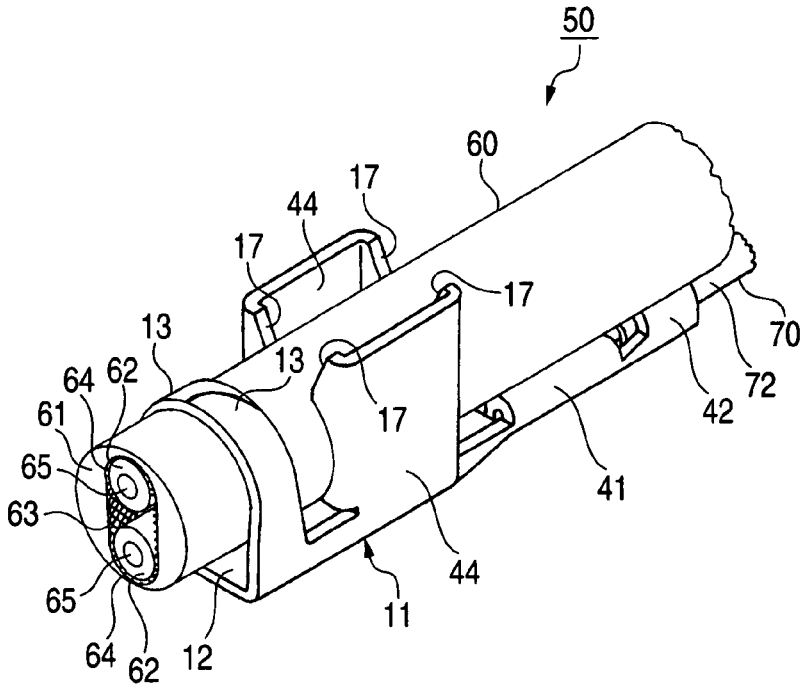
FIG. 12 is a perspective view showing a condition in which the shielded cable is connected to the connecting jig of FIG. 11.
Figure 13:
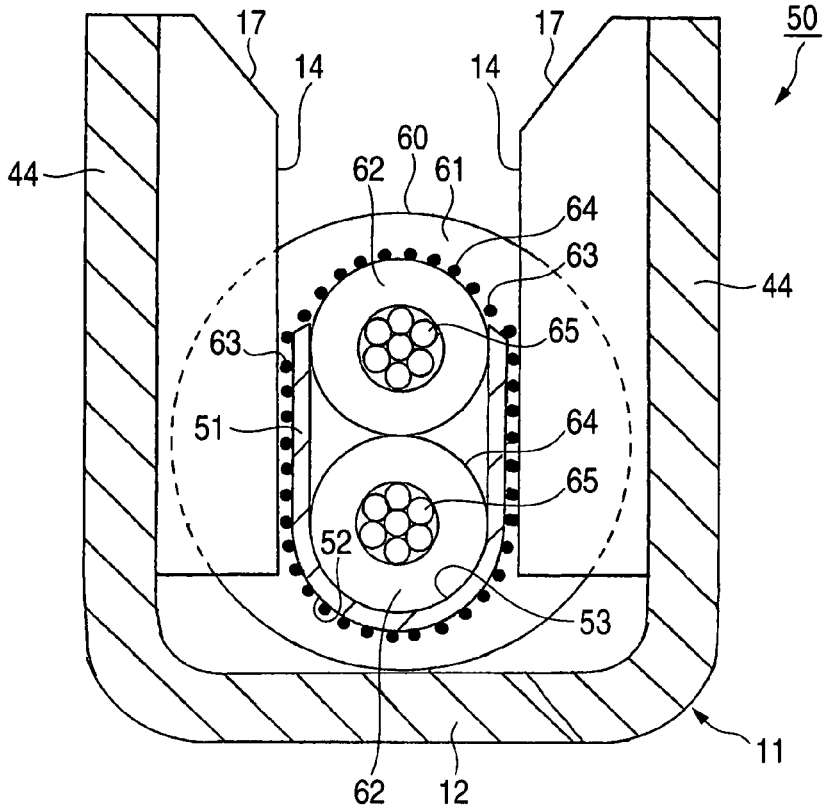
FIG. 13 is a cross-sectional view around the shielded cable of FIG. 12.

Next, a fourth embodiment of a shielded cable connecting structure of the invention will be described with reference to FIGS. 11 to 13. FIG. 11 is a perspective view showing the manner of connecting a shielded cable to a shielded cable connecting jig used in the fourth embodiment of the shielded cable connecting structure of the invention, FIG. 12 is a perspective view showing a condition in which the shielded cable is connected to the connecting jig of FIG. 11, and FIG. 13 is a cross-sectional view around the shielded cable of FIG. 12.

As shown in FIG. 11, the shielded cable connecting jig 50, used in the fourth embodiment of the shielded cable connecting structure of the invention, includes a spacer 51 of a U-shape. The other portions are identical in construction to the corresponding portions of the third embodiment.

The spacer 51 is upwardly open, and its outer surface defines a braided wire connecting portion 52 (in the form of a convex surface) similar to a shape of the inner side of a braided wire 63 of the shielded cable 60, and its outer surface defines a wire support surface 53. The spacer 51 has the U-shape, and therefore is suitably used for connecting the shielded cable containing a plurality of (that is, two or more) wires 64.

The spacer 51 is inserted into the interior of the braided wire 63 from a cut end of the shielded cable 60. At this time, the spacer 51 is inserted into a position where the spacer 51, contacting the wires 64 and 64, is to be pressed contacted with press-contacting portions 14 and 14 through the braided wire 63.

As shown in FIG. 12, the wires 64 and 64 of the shielded cable 60 (having the spacer 51 inserted therein and including the braided wire 63 braided around the wires 64 and 64) are pressed to be inserted into the press-contacting portions 14 and 14, and press-fastening portions 13 and 13 are press-fastened to the shielded cable 60, thereby fixing the shielded cable 60 to the shielded cable connecting jig 50.

The shielded cable 60 having the spacer 43 inserted therein is pressed to be inserted into the pair of press-contacting portions 14 and 14, so that the press-contacting portions 14 and 14 cut an outer sheath 61 of the shielded cable 60, and are press-contacted with the braided wire 63 to be electrically connected thereto, as shown in FIG. 13.

In the shielded cable connecting jig 50, the braided wire connecting portion 52 of the spacer 51, inserted in the press-contacting portions 14 and 14 (that is, inserted between opposed press-contacting blades (14 and 14) of each press-contacting portion 14), is electrically connected at its opposite side surfaces to the press-contacting portions 14 and 14 with large contact areas, with the braided wire 63 held between the braided wire connecting portion 52 and the press-contacting blades (14). Therefore, even when a disturbance develops around the shielded cable 60, disturbance components captured by the braided wire 63 positively flow from the press-contacting portions 14 and 14 to a grounding wire 70 through the spacer 51, thereby protecting conductors 65 and 65 of the wires 64 and 64 from the disturbance.

As described above, in the shielded cable connecting structure of the fourth embodiment, when the shielded cable 60 is pressed to be inserted into the press-contacting portions 14 and 14, the braided wire 63 is connected to the press-contacting portions 14 and 14, and also the spacer 51 separate from the connecting member body 11 is connected to the braided wire 63, so that a connecting path of the braided wire 63 is formed with a large current-carrying capacity. Therefore, the braided wire 63, while kept braided around the inner sheaths 62, is electrically connected to the connecting member body 11 without being gathered or twisted.

Furthermore, in the shielded cable connecting structure of the fourth embodiment, when connecting the shielded cable 60 to the grounding circuit, the shielded cable 60 can be easily grounded via the spacer 43 by grounding the grounding wire 70.

Fifth Embodiment

Figure 14:
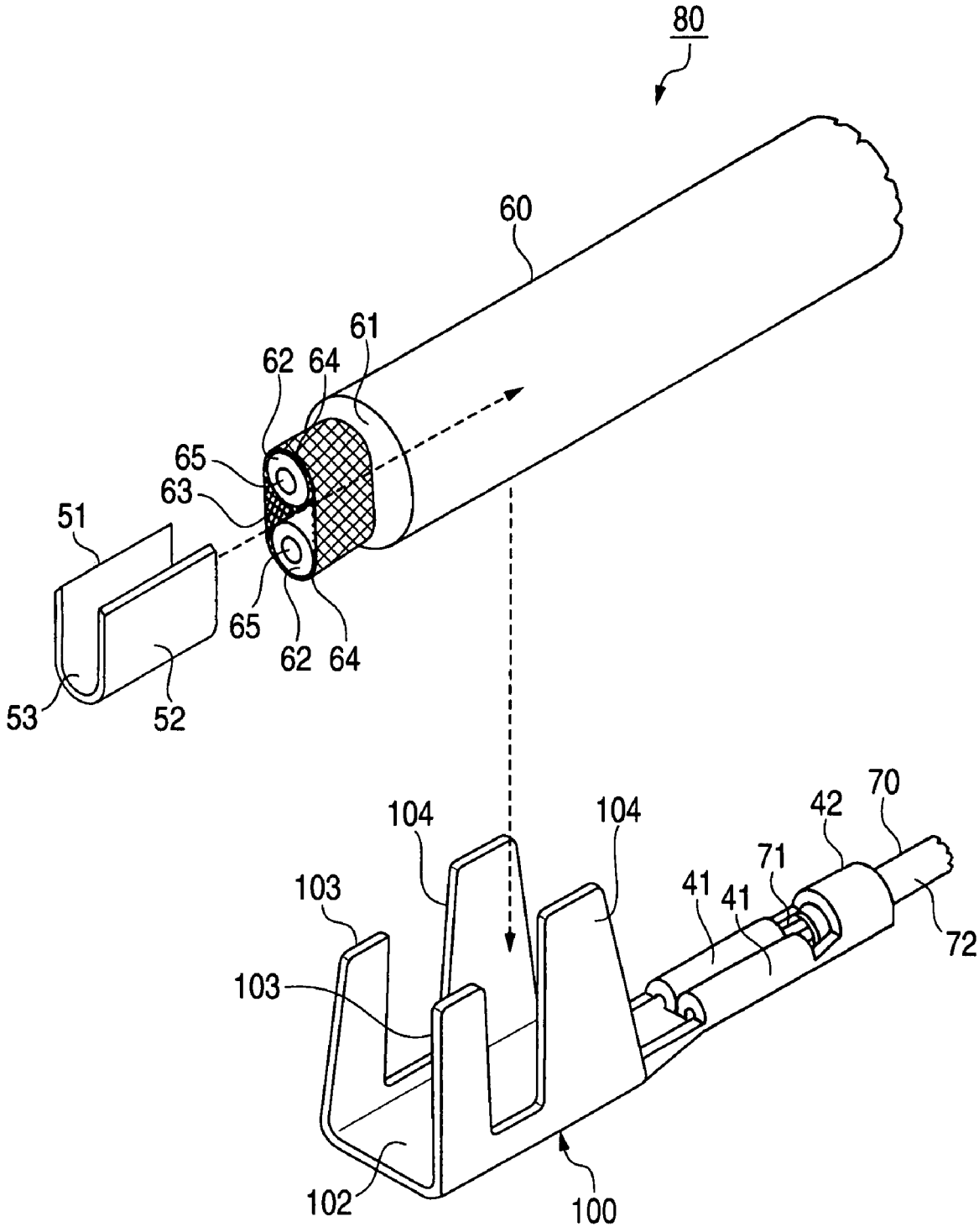
FIG. 14 is a perspective view showing the relation between a shielded cable and a press clamping-type shielded cable connecting jig used in a fifth embodiment of a shielded cable connecting structure of the invention.

Next, a fifth embodiment of a shielded cable connecting structure of the invention will be described with reference to FIGS. 14 to 16. FIG. 14 is a perspective view showing the relation between a shielded cable and a press clamping-type shielded cable connecting jig used in the fifth embodiment of the shielded cable connecting structure of the invention, FIG. 15 is a perspective view showing a condition in which the connecting jig of FIG. 14 is press-clamped to the shielded cable, and FIG. 16 is a cross-sectional view around the shielded cable of FIG. 15.

As shown in FIG. 14, the shielded cable connecting jig 80, used in the fifth embodiment of the shielded cable connecting structure of the invention, includes a spacer 51 of a U-shape similar to the spacer 51 used in the above fourth embodiment. The shielded cable connecting jig 80 includes a connecting member body 100 having a bottom plate 102, a pair of braided wire press-fastening portions (press-clamping portions) 103 and 13 formed on and extending upwardly respectively from opposite side edges of the bottom plate 102, and a pair of sheath press-fastening portions 104 and 104 formed on and extending upwardly respectively from the opposite side edges of the bottom plate 102 at a central portion of the connecting member body 100. The other portions are similar in construction to the corresponding portions of the above embodiment, and therefore will be designated respectively by identical reference numerals, and explanation thereof will be omitted. In this embodiment, although the spacer 51 is separate from the connecting member body 100, it can be formed integrally with the connecting member body 100 as in the first and second embodiments.

An outer sheath 61 is removed over a predetermined length from an end portion of the shielded cable 60, and the spacer 51 is inserted into the interior of a braided wire 63 at the sheath-removed end portion of the shielded cable 60. At this time, the spacer 51 is inserted into a position where the spacer 51, interposed between the exposed braided wire 63 and two wires 64 and 64, is to be press-clamped by the braided wire press-fastening portions 103 and 103.

Figure 15:
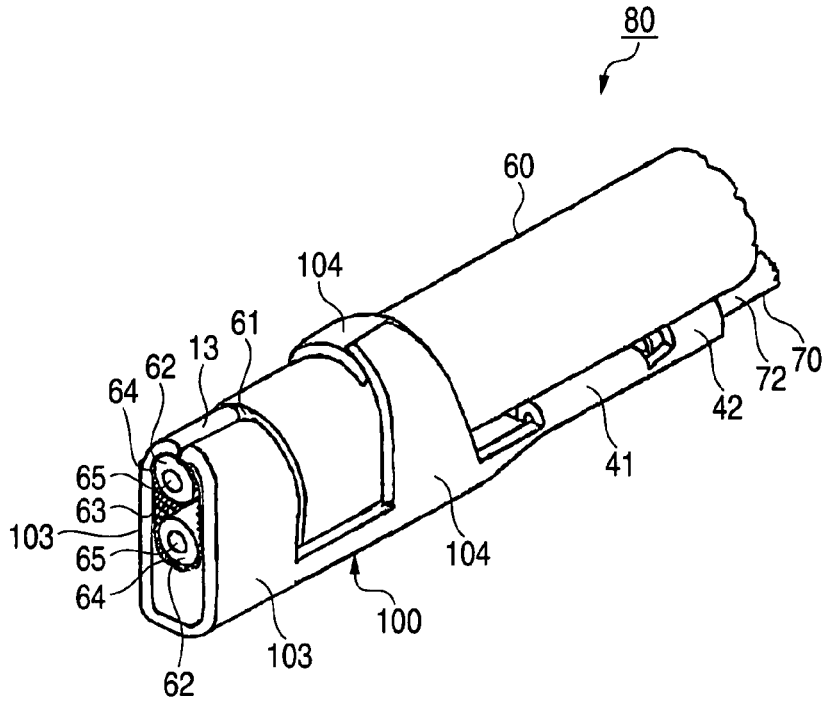
FIG. 15 is a perspective view showing a condition in which the connecting jig of FIG. 14 is press-clamped to the shielded cable.
Figure 16:
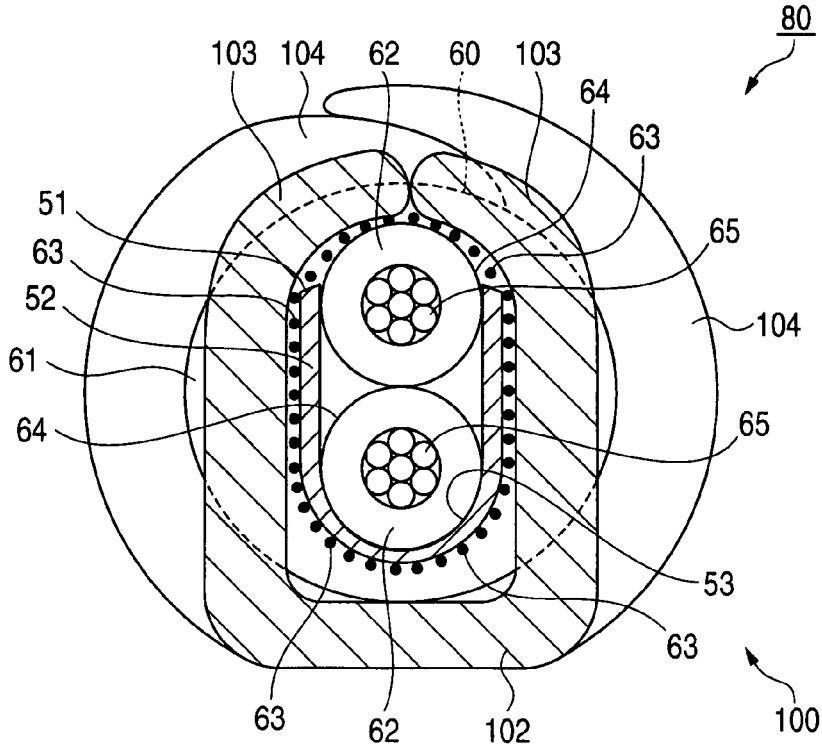
FIG. 16 is a cross-sectional view around the shielded cable of FIG. 15.
Figure 17:
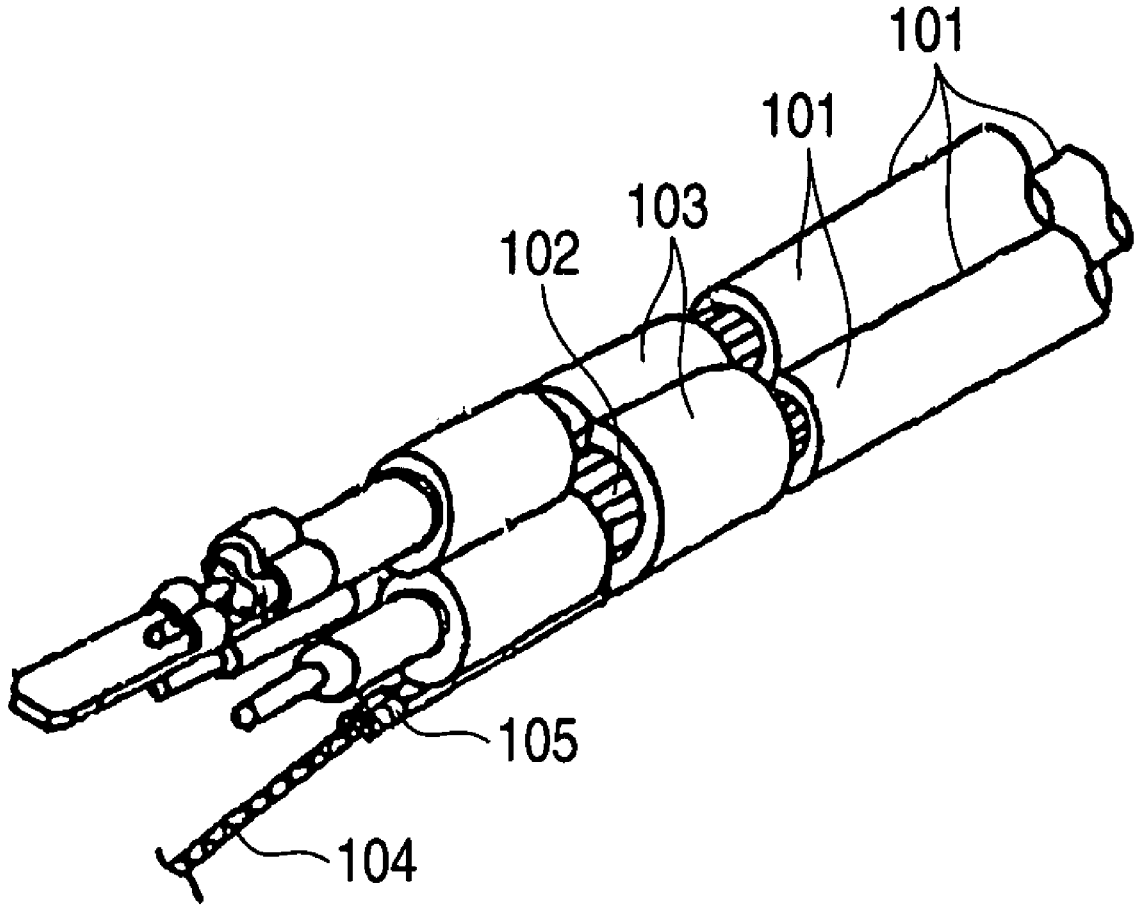
FIG. 17 is a view showing a related shielded cable connecting structure, showing its appearance.

As shown in FIG. 15, the shielded cable 60 is press-clamped by the braided wire press-fastening portions 103 and 103, with the braided wire 63 braided around the wires 64 and 64, and the sheath press-fastening portions 104 and 104 are press-fastened to the outer periphery of the outer sheath 61, thereby fixing the shielded cable 60 to the shielded cable connecting jig 80.

As shown in FIG. 16, the braided wire press-fastening portions 103 and 103 are press-clamped to the braided wire 63 (braided around the wires 64 and 64) at the end portion of the shielded cable 60 (in which the spacer 51 is inserted), and therefore are electrically connected to this braided wire 63.

In the shielded cable connecting jig 80, the braided wire press-fastening portions 103 and 103 are press-clamped to the outer periphery of the braided wire 63, with the inserted spacer 51 held between the braided wire 63 and inner sheaths 62 of the wires 64, and therefore the braided wire press-fastening portions 103 and 130 are electrically connected to the braided wire 63 with large contact areas. Therefore, even when a disturbance develops around the shielded cable 60, disturbance components captured by the braided wire 63 positively flow from the braided wire press-fastening portions 103 and 103 to a grounding wire 70 through the spacer 51, thereby protecting conductors 65 and 65 of the wires 64 and 64 from the disturbance.

As described above, in the shielded cable connecting structure of the fifth embodiment, the spacer 51 is pressed to be inserted into the gap between the exposed braided wire 63 and the wires 64 and 64 at the sheath-removed end portion of the shielded cable 60, and the braided wire press-fastening portions 103 and 103 are press-clamped to the outer periphery of the exposed braided wire 63. As a result, the braided wire press-fastening portions 103 and 103 are electrically connected to the braided wire 63 with the large contact areas, so that a connecting path of the braided wire 63 is formed with a large current-carrying capacity. Therefore, the braided wire 63, while kept braided around the inner sheaths 62, is electrically connected to the connecting member body 100 without being gathered or twisted.

The invention is not limited to the above embodiments, and suitable modifications, improvement and so on can be made. For example, the shape of the press-contacting portions is given merely as one example, and is not limited to any specified shape, and one press-contacting portion (including the pair of opposed press-contacting blades) may be provided, or more than two press-contacting portions may be provided in a consecutive manner.

Although the invention has been illustrated and described for the particular preferred embodiments, it is apparent to a person skilled in the art that various changes and modifications can be made on the basis of the teachings of the invention. It is apparent that such changes and modifications are within the spirit, scope, and intention of the invention as defined by the appended claims.

The present application is based on Japan Patent Application No. 2006-042734 filed on Feb. 20, 2006, the contents of which are incorporated herein for reference.

What is claimed is:

1. A shielded cable connecting structure for connecting a shielded cable, the shielded cable including an electric wire portion which has a conductor and an inner sheath covering the conductor, a braided wire braided around the inner sheath, and an outer sheath covering the braided wire, the shielded cable connecting structure comprising:

a connecting member that includes:

a connecting main body;

a press-fastening portion for fastening at least part of the shielded cable;

a connecting portion including a pair of press-contacting portions and a spacer supporting portion, and defining a space thereamong in which the shield cable is received, the press-contacting portions cutting the outer sheath and contacting the braided wire upon insertion of the shielded cable in the space; and a spacer for contacting the braided wire, wherein the spacer is arranged between supporting portion and the shielded cable inserted in the space; and wherein the spacer increases a contact pressure of the braided wire with the connecting portion.

2. The shielded cable connecting structure according to claim 1, wherein the connecting portion is a press-contacting portion or a press-clamping portion.

3. The shielded cable connecting structure according to claim 1, wherein the spacer is formed at a part of the connecting main body.

4. The sheilded cable connecting structure according to claim 1, wherein the spacer is separate from the connecting main body.

5. The shielded cable connecting structure according to claim 1, wherein the spacer is received between the inner sheath and the braided wire of the shielded cable; and wherein the spacer is electrically connected to the connecting portion through the braided wire.

6. The shielded cable connecting structure according to claim 1, wherein the connecting member is electrically connected to the sheilded cable and a grounding wire.

* * * * *